US005752224A

United States Patent [19]

Tsutsui et al.

[11] Patent Number: 5,752,224

[45] Date of Patent: May 12, 1998

[54] INFORMATION ENCODING METHOD AND APPARATUS, INFORMATION DECODING METHOD AND APPARATUS INFORMATION TRANSMISSION METHOD AND INFORMATION RECORDING MEDIUM

[75] Inventors: Kyoya Tsutsui, Kanagawa; Robert Heddle, Tokyo, both of Japan

[73] Assignee: Sony Corporation, Tokyo, Japan

[21] Appl. No.: 868,665

[22] Filed: Jun. 4, 1997

Related U.S. Application Data

[63] Continuation of Ser. No. 413,391, Mar. 30, 1995, abandoned.

[30] Foreign Application Priority Data

Apr. 1, 1994 [JP] Japan ..... 6-064855

[51] Int. Cl.[6] ..... G10L 3/00

[52] U.S. Cl. ..... 704/225; 704/224; 704/501; 381/102

[58] Field of Search ..... 704/225, 226; 381/102

[56] References Cited

U.S. PATENT DOCUMENTS

| | | | |
|---|---|---|---|
| 3,349,183 | 10/1967 | Campanella . | |
| 4,184,049 | 1/1980 | Crochiere et al. | 179/1 |
| 4,492,930 | 1/1985 | Knowles et al. | 330/284 |
| 4,516,241 | 5/1985 | Farah et al. | 370/110.1 |
| 4,535,472 | 8/1985 | Tomcik | 381/31 |
| 4,569,058 | 2/1986 | Grallert | 375/27 |
| 4,573,187 | 2/1986 | Bui et al. | 381/43 |
| 4,622,598 | 11/1986 | Doi et al. | 360/22 |
| 4,625,286 | 11/1986 | Papamichalis et al. | 364/513.5 |
| 4,696,040 | 9/1987 | Doddington et al. | 381/46 |
| 4,697,212 | 9/1987 | Osawa et al. | 360/48 |

(List continued on next page.)

FOREIGN PATENT DOCUMENTS

| | | | |
|---|---|---|---|
| 0 255 111 A2 | 2/1988 | European Pat. Off. | G11B 20/10 |
| 0 349 325 A2 | 1/1990 | European Pat. Off. | G11B 20/10 |
| 0370277 A3 | 5/1990 | European Pat. Off. | H04B 1/66 |
| 0 409 248 A2 | 1/1991 | European Pat. Off. | H03M 7/30 |
| 0 420 745 A2 | 4/1991 | European Pat. Off. | H04B 1/66 |
| 0 423 050 A1 | 4/1991 | European Pat. Off. | H04B 1/66 |

(List continued on next page.)

OTHER PUBLICATIONS

T. Makiko et al., "Block Size Decision Method for Movement Compensation," Japanese Patent Abstract, Publication No.: JP1069181, Publication Date: Mar. 15, 1989; vol. 13, No.: 285.

D. Esteban et al., "Application of Quadrature Mirror Filters to Split Band Voice Coding Schemes," 1977 IEEE International Conference on Acoustics, Speech & Signal Processing, May 1977, pp. 191–195.

(List continued on next page.)

*Primary Examiner*—David R. Hudspeth
*Assistant Examiner*—Vijay B. Chawan
*Attorney, Agent, or Firm*—Limbach & Limbach L.L.P.

[57] ABSTRACT

An information encoding method and apparatus, an information decoding method and apparatus and an information transmission method in which encoding and decoding with higher efficiency and higher sound quality may be achieved by gain control in meeting with the degree of amplitude changes in the attack portion and the pre-echo may be prevented from occurring. Gain control and gain control compensation operations are performed by applying a gain control function with a smaller gain control quantity and by applying a gain control function with a larger gain control quantity to a signal waveform portion having a level just ahead of an attack portion higher than a pre-set level and to a signal waveform portion having an extremely low level just ahead of the attack portion, respectively. By changing the gain control quantity depending on the degree of amplitude changes at the attack portion of the signal waveform, the pre-echo is prevented from occurring, while the efficiency is prevented from being lowered due to energy diffusion in the frequency domain.

30 Claims, 11 Drawing Sheets

U.S. PATENT DOCUMENTS

| | | | |
|---|---|---|---|
| 4,706,265 | 11/1987 | Furukawa | 375/122 |
| 4,748,579 | 5/1988 | Zibman et al. | 364/736 |
| 4,873,589 | 10/1989 | Inazawa et al. | 360/53 |
| 4,882,754 | 11/1989 | Weaver et al. | 381/35 |
| 4,885,790 | 12/1989 | McAulay | 381/36 |
| 4,896,362 | 1/1990 | Veldhuis et al. | 381/30 |
| 4,903,301 | 2/1990 | Kondo et al. | 381/30 |
| 4,912,763 | 3/1990 | Galand et al. | 381/31 |
| 4,932,062 | 6/1990 | Hamilton | 381/43 |
| 4,949,383 | 8/1990 | Koh et al. | 381/31 |
| 4,972,484 | 11/1990 | Theile et al. | 381/37 |
| 5,016,107 | 5/1991 | Sasson et al. | 358/209 |
| 5,040,217 | 8/1991 | Brandenburg et al. | 381/47 |
| 5,105,463 | 4/1992 | Veldhuis et al. | 381/30 |
| 5,109,417 | 4/1992 | Fielder et al. | 381/36 |
| 5,115,240 | 5/1992 | Fujiwara et al. | 341/51 |
| 5,117,228 | 5/1992 | Fuchigami et al. | 341/220 |
| 5,142,656 | 8/1992 | Fielder et al. | 381/37 |
| 5,150,387 | 9/1992 | Yoshikawa et al. | 375/122 |
| 5,157,760 | 10/1992 | Akagiri | 395/2 |
| 5,159,611 | 10/1992 | Tomita et al. | 375/34 |
| 5,166,686 | 11/1992 | Sugiyama | 341/155 |
| 5,185,800 | 2/1993 | Mahieux | 381/29 |
| 5,204,677 | 4/1993 | Akagiri et al. | 341/118 |
| 5,218,561 | 6/1993 | Iwadare | 364/725 |
| 5,222,189 | 6/1993 | Fielder | 395/2 |
| 5,241,603 | 8/1993 | Akagiri et al. | 381/37 |
| 5,243,588 | 9/1993 | Maeda et al. | 369/54 |
| 5,244,705 | 9/1993 | Tsurushima et al. | 428/64 |
| 5,264,846 | 11/1993 | Oikawa | 341/76 |
| 5,268,685 | 12/1993 | Fujiwara | 341/76 |
| 5,285,476 | 2/1994 | Akagiri et al. | 375/25 |
| 5,294,925 | 3/1994 | Akagiri | 341/50 |
| 5,297,236 | 3/1994 | Antill et al. | 395/2.12 |
| 5,301,205 | 4/1994 | Tsutsui et al. | 375/1 |
| 5,311,561 | 5/1994 | Akagiri | 375/122 |
| 5,349,549 | 9/1994 | Tsutsui | 364/725 |
| 5,357,594 | 10/1994 | Fielder | 395/2.2 |
| 5,375,189 | 12/1994 | Tsutsui | 395/2.38 |
| 5,381,143 | 1/1995 | Shimoyoshi et al. | 341/51 |
| 5,388,093 | 2/1995 | Yoshida et al. | 369/124 |
| 5,388,159 | 2/1995 | Sakata | 381/61 |
| 5,388,209 | 2/1995 | Akagiri | 395/2.38 |
| 5,394,473 | 2/1995 | Davidson | 381/36 |
| 5,406,428 | 4/1995 | Suzuki | 360/53 |
| 5,414,795 | 5/1995 | Tsutsui et al. | 395/2.13 |
| 5,438,643 | 8/1995 | Akagiri et al. | 395/2.1 |
| 5,461,378 | 10/1995 | Shimoyoshi et al. | 341/51 |
| 5,471,558 | 11/1995 | Tsutsui | 395/2.28 |
| 5,479,562 | 12/1995 | Fielder et al. | 395/2.38 |
| 5,490,170 | 2/1996 | Akagiri et al. | 375/240 |

FOREIGN PATENT DOCUMENTS

| | | | |
|---|---|---|---|
| 0 424 016 A3 | 4/1991 | European Pat. Off. | H04B 1/66 |
| 0 446 031 A3 | 9/1991 | European Pat. Off. | H04B 1/66 |
| 0 458 645 A2 | 11/1991 | European Pat. Off. | H04B 1/66 |
| 0 463 473 A2 | 1/1992 | European Pat. Off. | G06F 15/332 |
| 0 466 190 A2 | 1/1992 | European Pat. Off. | G11B 20/10 |
| 0 473 367 A1 | 3/1992 | European Pat. Off. | H03M 7/30 |
| 0 506 394 A2 | 9/1992 | European Pat. Off. | G10L 7/00 |
| 0 525 809 A2 | 2/1993 | European Pat. Off. | H04B 1/66 |
| 61-201526 | 9/1986 | Japan | H94B 14/00 |
| 63-7023 | 1/1988 | Japan | H03M 1/00 |
| A 01 069 181 | 3/1989 | Japan | H04N 7/137 |
| 3-132228 | 6/1991 | Japan | H04B 14/00 |
| 2237463 | 1/1991 | United Kingdom | H03G 3/32 |
| 2277839 | 9/1994 | United Kingdom | H03G 3/20 |
| WO 90/09064 | 8/1990 | WIPO | H04B 1/66 |
| WO 91/16769 | 10/1991 | WIPO | H04B 1/66 |
| WO 92/17884 | 10/1992 | WIPO | G11B 20/10 |

OTHER PUBLICATIONS

J.H. Rothweiler, "Polyphase Quadrature Filters—A New Subband Coding Technique," ICASSP 83 Proceedings, IEEE International Conference on Acoustics, Speech & Signal Processing, Apr. 1983, vol. 3 of 3, pp. 1280–1283.

E.F. Schröder et al., "High Quality Digital Audio Encoding with 3.0 Bits/Sample using Adaptive Transform Coding," AES 80th Convention Mar. 4–7, 1986, Switzerland, Audio Engineering Society Preprint, pp. 1–7.

J.D. Johnston, "Transform Coding of Audio Signals Using Perceptual Noise Criteria," IEEE Journal on Selected Areas in Communication, vol. 6, No. Feb. 1988, pp. 314–323.

G. Stoll et al., "Masking–pattern adapted subband coding: use of the dynamic bit–rate margin," AES 84th Convention Mar. 1–4, 1988, Paris, Audio Engineering Society Preprint, pp. 1–33.

Y. Mahieux et al., "Transform Coding of Audio Signals at 64 KBIT/S," Globecom '90, IEEE Global Telecommunications Conference & Exhibition, Dec. 2–5, 1990, California, pp. 405.2.1–405.2.5.

K. Brandenburg et al., "Aspec: Adaptive spectral entropy coding of high quality music signals, " AES 90th Convention, Feb. 19–22, 1991, Paris, Audio Engineering Society Preprint, pp. 1–10, including one page of Figs. 1 and 2.

S. Gomez et al., "An application–specific FFT processor," Electronic Engineering, Jun. 1988, No. 738, pp. 99–100 and 104–106.

S. Magar et al., "An Application Specific DSP Chip Set for 100 MHz Data Rates," ICASSP 88, IEEE International Conference on Acoustics, Speech & Signal Processing, pp. 1989–1992.

J.D. Johnston, "Perceptual Transform Coding of Wideband," IEEE Journal, 1989, pp. 1993–1996.

N. Jayant, "Signal Compression: Technology Targets and Research Directions," IEEE Journal on Selected Areas in Communications, Jun. 1992, vol. 10, No. 5, pp. 796–810.

R.E. Crochiere et al., "Digital Coding of Speech in Sub–bands," American Telephone and Telegraph Company, The Bell System Technical Journal, vol. 55, No. 8, Oct. 1976, pp. 1069–1085.

J.P. Princen et al., "Subband/Transform Coding Using Filter Bank Designs Based on Time Domain Aliasing Cancellation," IEEE, 1987, pp. 2161–2164.

R. Zelinski et al., "Adaptive Transform Coding of Speech Signals," IEEE Transactions on Acoustics, Speech, and Signal Processing, vol. ASSP–25, No. 4, Aug. 1977, pp. 299–309.

M.A. Krasner, "The Critical Band Coder–Digital Encoding of Speech Signals Based on the Perceptual Requirements of the Auditory System," IEEE Journal, vol. 1–3, 1980, pp. 327–331.

de Jong et al., ("High Performance Integrated Receiver Circuit for Optical Fiber Transmission of Wideband FM Video Signals", IEEE Transactions on Consumer Electronics v CE–33, Aug. 1987, pp. 473–480).

Ammon et al., ("High Performance FM–IF IC for systems with search tuning stop and Multipath Interference Detection", Aug. 1986, IEEE Transactions on Consumer Electronics, V CE–32, No. 3, pp. 475–481).

INFORMATION ENCODING METHOD AND APPARATUS, INFORMATION DECODING METHOD AND APPARATUS INFORMATION TRANSMISSION METHOD AND INFORMATION RECORDING MEDIUM

This is a continuation of application Ser. No. 08/413,391 filed on Mar. 30, 1995, now abandoned.

BACKGROUND OF THE INVENTION

This invention relates to an information encoding method and apparatus, an information decoding method and apparatus and an information transmission method for encoding input digital data by high efficiency encoding, transmitting, recording, reproducing and decoding playback signals, and to an information recording medium having the information recorded thereon by the encoding method and apparatus.

There exist a variety of high efficiency encoding techniques of encoding audio or speech signals. Examples of these techniques include transform coding in which a frame of digital signals representing the audio signal on the time axis is converted by an orthogonal transform into a block of spectral coefficients representing the audio signal on the frequency axis, and a sub-band coding in which the frequency band of the audio signal is divided by a filter bank into a plurality of sub-bands without forming the signal into frames along the time axis prior to coding. There is also known a combination of sub-band coding and transform coding, in which digital signals representing the audio signal are divided into a plurality of frequency ranges by sub-band coding, and transform coding is applied to each of the frequency ranges.

Among the filters for dividing a frequency spectrum into a plurality of equal-width frequency ranges include the quadrature mirror filter (QMF) as discussed in R. E. Crochiere, Digital Coding of Speech in Sub-bands, 55 Bell Syst. Tech J. No.8 (1976). With such QMF filter, the frequency spectrum of the signal is divided into two equal-width bands. With the QMF, aliasing is not produced when the frequency bands resulting from the division are subsequently combined together.

In "Polyphase Quadrature Filters- A New Subband Coding Technique", Joseph H. Rothweiler ICASSP 83, Boston, there is shown a technique of dividing the frequency spectrum of the signal into equal-width frequency bands. With the present polyphase QMF, the frequency spectrum of the signals can be divided at a time into plural equal-width frequency bands.

There is also known a technique of orthogonal transform including dividing the digital input audio signal into frames of a predetermined time duration, and processing the resulting frames using a discrete Fourier transform (DFT), discrete cosine transform (DCT) and modified DCT (MDCT) for converting the signal from the time axis to the frequency axis. Discussions on MDCT may be found in J. P. Princen and A. B. Bradley, Subband Transform Coding Using Filter Bank Based on Time Domain Aliasing Cancellation", ICASSP 1987.

By quantizing the signals divided on the band basis by the filter or orthogonal transform, it becomes possible to control the band subjected to quantization noise and psychoacoustically more efficient coding may be performed by utilizing the so-called masking effects. If the signal components are normalized from band to band with the maximum value of the absolute values of the signal components, it becomes possible to effect more efficient coding.

In a technique of quantizing the spectral coefficients resulting from an orthogonal transform, it is known to use sub bands that take advantage of the psychoacoustic characteristics of the human auditory system. That is, spectral coefficients representing an audio signal on the frequency axis may be divided into a plurality of critical frequency bands. The width of the critical bands increase with increasing frequency. Normally, about 25 critical bands are used to cover the audio frequency spectrum of 0 Hz to 20 kHz. In such a quantizing system, bits are adaptively allocated among the various critical bands. For example, when applying adaptive bit allocation to the spectral coefficient data resulting from MDCT, the spectral coefficient data generated by the MDCT within each of the critical bands is quantized using an adaptively allocated number of bits.

There are presently known the following two bit allocation techniques. For example, in IEEE Transactions of Acoustics, Speech and Signal Processing, vol. ASSP-25, No.4, August 1977, bit allocation is carried out on the basis of the amplitude of the signal in each critical band. This technique produces a flat quantization noise spectrum and minimizes the noise energy, but the noise level perceived by the listener is not optimum because the technique does not effectively exploit the psychoacoustic masking effect.

In the bit allocation technique described in M. A. Krassner, The Critical Band Encoder- Digital Encoding of the Perceptual Requirements of the Auditory System, ICASSP 1980, the psychoacoustic masking mechanism is used to determine a fixed bit allocation that produces the necessary signal-to-noise ratio for each critical band. However, if the signal-to-noise ratio of such a system is measured using a strongly tonal signal, for example, a 1 kHz sine wave, non-optimum results are obtained because of the fixed allocation of bits among the critical bands.

For overcoming these inconveniences, a high efficiency encoding apparatus has been proposed in which the total number of bits available for bit allocation is divided between a fixed bit allocation pattern pre-set for each small block and a block-based signal magnitude dependent bit allocation, and the division ratio is set in dependence upon a signal which is relevant to the input signal such that the smoother the signal spectrum, the higher becomes the division ratio for the fixed bit allocation pattern.

With this technique, if the energy is concentrated in a particular spectral component, as in the case of a sine wave input, a larger number of bits are allocated to the block containing the spectral component, for significantly improving the signal-to-noise characteristics in their entirety. Since the human auditory system is highly sensitive to a signal having acute spectral components, such technique may be employed for improving the signal--to-noise ratio for improving not only measured values but also the quality of the sound as perceived by the ear.

In addition to the above techniques, a variety of other techniques have been proposed, and the model simulating the human auditory system has been refined, such that, if the encoding device is improved in its ability, encoding may be made with higher efficiency in light of the human auditory system.

If DFT or DCT is utilized as the method for transforming the waveform signal into a spectral signal, and transform is executed using a time block made up of M samples, M independent real-number samples are produced. Since a given block is usually overlapped by M1 samples with both neighboring blocks for reducing connection distortion between time blocks, M real-number data are quantized and encoded in DFT or DCT for (M–M1) samples.

On the other hand, if the waveform signal is transformed into a spectral signal by MDCT, since M independent real-number data are produced from 2M samples having N samples each overlapped with both neighboring samples, M real-number data are quantized and encoded in MDCT for M samples. In a decoding device, the coded data from MDCT are inverse-transformed at each block to produce waveform elements which are summed together with interference with one another to reconstruct the waveform signal.

If the time block length for transform is increased, the frequency resolution is increased, so that the energy is concentrated in a specified spectral component. For this reason, by employing MDCT in which transform is executed with a long block length resulting from half-overlap with both neighboring blocks, and the number of the resulting spectral signals is not increased as compared to the number of the original time samples, encoding may be achieved with high efficiency than with the use of DFT or DCT. The inter-block distortion of the waveform signal may be reduced by overlapping neighboring blocks with a long overlap length.

If the signal is resolved into frequency components which are quantized and encoded, the waveform signal produced on decoding and synthesizing the frequency components is subjected to quantization noise. However, if the original signal components are varied acutely, the portion of the quantization noise on the waveform signal for which the original signal waveform is low in magnitude is increased. Such quantization noise is not masked by concurrent masking and hence is offensive to the ear. The quantization noise thus produced in the attack portion where the sound is increased acutely is termed pre-echo.

Above all, if the input audio signal is resolved by orthogonal transform into a large number of frequency components, time resolution is deteriorated and the pre-echo is generated for a long time duration.

The principle of the generation of the pre-echo in case of employing orthogonal transform for division of the frequency spectrum is explained by referring to FIGS. (1A) and (1B).

If the spectral signal produced on forward orthogonal transform of an input waveform signal SW with the aid of the window function shown in FIG. (1A) is subjected to a quantization noise QN, and the spectral signal carrying the quantization noise is restored to the waveform signal on the time axis, the quantization noise is spread over the transform block in its entirety.

If the input signal waveform is increased acutely at an intermediate position in the transform block, as shown in FIG. 1(B), the quantization noise QN becomes larger relative to the signal waveform SW in the small original signal waveform domain, so that concurrent masking is not in operation and hence the noise sounds obnoxious to the ear as the pre-echo.

If the transform duration for orthogonal transform is reduced, the time duration of generation of the quantization noise is also reduced. However, the frequency resolution is deteriorated to lower the coding efficiency for the quasi-stationary portion of the signal waveform. For overcoming such deficiency, there is proposed a method for reducing the transform length at the cost of the frequency resolution only at the acutely changing portion of the signal waveform.

FIGS. (2A) and (2B) illustrate a prior-art technique for obviating the above hindrance by the pre-echo. In a quasi-stationary signal waveform, the encoding efficiency is improved in general by increasing the transform block length, since the energy is thereby concentrated at a specified spectral coefficient. However, in the signal waveform portion with an acutely changing sound intensity, the pre-echo becomes outstanding for a longer transform block length.

If a short transform window function diminishing the transform block length, as shown in FIG. 2(A), is applied to a waveform portion with an acutely changing sound intensity, for example, a waveform portion with an acutely rising amplitude of the input signal waveform SW, as shown in FIG. 2(B), for thereby sufficiently reducing the time duration of pre-echo, the reverse masking effect by the original signal is in operation for obviating the hindrance to the hearing mechanism. This information is exploited with the method indicated in FIGS. 2(A) and 2(B) for selectively changing over the transform block length depending on the properties of respective portions of the signal waveform.

If this information is exploited, sufficient frequency resolution is assured in the quasi-stationary portion, while the pre-echo at an attack portion is of an extremely short duration and is masked by the backward masking, thus enabling efficient encoding.

However, with the method of varying the transform length, it is necessary to provide the encoding method and apparatus with transform means capable of coping with transform of varying lengths. In addition, since the number of spectral components produced on transform is proportional to the transform length, the frequency band to which the spectral components belong is changed depending on the transform length. Thus, if the plural spectral components are encoded based on the critical bands, the number of the spectral components contained in the respective critical bands are varied, thus complicating the encoding and decoding operations. If the transform length is varied in this manner, the encoding and decoding apparatus becomes complicated in structure.

As a method for overcoming the pre-echo with the transform block length remaining unchanged, there is disclosed in JP Patent Kokai Publication JP-A-3-132228 a method consisting in performing adaptive gain control on the input waveform signal and transforming the waveform signal by DFT or DCT into spectral signals and finally encoding the spectral signals. The gain control herein means increasing the gain, that is the amplitude, in the portion of the input signal having a low power level.

With the proposed method, the encoding device performs gain control of acutely lowering the gain at the attack portion before transform to spectral signals and of again raising the gain at the portions other than the attack portion depending on the signal level attenuation. The decoding device outputs a signal after reverse gain control of correcting the gain control for the signal waveform obtained on inverse orthogonal transform. This suppresses the quantization noise in the smaller amplitude signal portion having a lower masking level. In addition, since the transform length may be constant at all times, the encoding device and the decoding device may be simplified in construction.

However, with the proposed method, gain control needs to be performed during signal level attenuation. Since gain control leads in general to distortion of the original signal waveform, the energy distribution occurs on transform into spectral signals, thus rendering it difficult to realize sufficient encoding. During signal attenuation, the forward masking, that is masking of the temporally forward sound by the temporally backward sound, is strongly in operation, so that it is more crucial to lower the noise level itself than to temporally control the generation of the quantization noise. On the other hand, it is not desirable to control the gain at all times in view of the volume of the arithmetic-logical operations.

In JP Patent Kokai Publications JP-A-61-201526 and JP-A-63-7023, there is disclosed another method of preventing the pre-echo with the constant transform block length. That is, with the encoding device, the input signal waveform is sliced on the time block basis and windowed. The attack portion is ten detected and the small-amplitude waveform portion directly ahead of the attack portion is amplified, after which the waveform portion is amplified and transformed into spectral signals using DFT and DCT. With the decoding device, the spectral signals are inverse-transformed by inverse DFT (IDFT) or inverse DCT (IDCT) and compensation is made for amplification of the signal portion just ahead of the attack portion by the encoding device in order to prevent the pre-echo. With this technique, the transform length may be constant at all times and the encoding and decoding devices may be simplified in construction.

In FIGS. 3(A), 3(B) and 3(C) there is shown an operating principle of the encoding and decoding exploiting the windowing technique as disclosed in the above-identified JP Patent Kokai Publications JP-A-61-201526 and JP-A-63-7023. In FIGS. 4 and 5, there is shown the processing flow by the encoding device and the decoding device exploiting the windowing technique.

The signal waveform shown in FIG. 3(A) enters an input terminal 400 in FIG. 4. The signal waveform is multiplied by a windowing circuit 401 with a window function shown in FIG. 3(B) for setting time windows temporally consecutive and overlapping with one another and for slicing a time waveform signal. The window function is a characteristic curve shown in the above-identified JP Patent Kokai Publications JP-A-61-201526. The attack detection circuit 402 detects the attack portion (the portion with acutely rising input signal amplitude portion). If the attack portion is detected, the small amplitude waveform portion is amplified. If the attack portion is not detected, the small amplitude waveform portion is not amplified. An output of the gain control circuit 403 is routed to a forward orthogonal transform circuit 404 where it is transformed into spectral signals by DFT or DCT. The resulting spectral signals are normalized and quantized by a normalization quantization circuit 405 so as to be encoded by an encoding circuit 406 and outputted as a code string at an output terminal 407.

In the decoding device shown in FIG. 5, the code string signal supplied to an input terminal 410 is decoded by a decoding circuit 411 and thence routed to an inverse normalization and inverse quantization circuit 412. An output of the inverse normalization and inverse quantization circuit 412 is inverse-transformed into time-domain signal by IDFT or IDCT and thence routed to a gain control compensation circuit 414 for compensating the gain control applied by the encoding device. An output of the gain control compensation circuit 414 is routed to an adjacent block synthesis circuit 415 where it is synthesized with neighboring block so as to be outputted at an output terminal 416.

With the proposed method, since the attack portion is detected of the windowed and deformed waveform signal, the portion with larger amplitudes is relaxed at both block ends. Thus it may occur that, as shown in FIGS. 3(A), 3(B) an 3(C) the attack portion is not detected and the attack portion is detected only at the next block B12. However, if DFT or DCT is employed as the orthogonal transform technique, the original time-domain blocks may be restored by inverse orthogonal transforming the spectral signals produced by forward orthogonal transform. Consequently, there is no problem raised if the compensation for gain control is made by the decoding device on the block basis.

However, the illustrative gain control values given in the above Publications are small. For example, it is stated in the above-identified JP Patent Kokai Publications JP-A-61-201526 and JP-A-63-7023 that gain control is performed if there is the difference of not less than 20 dB between consecutive sub-blocks for detecting the attack portion. As an illustrative example, the pre-echo with the gain control quantity of 5, that is the pre-echo having the amplitude five times as large as the directly previous amplitude, is a quantization noise and acts as hindrance on the human auditory system with rise in the signal compression ratio. However, if the compression ratio is increased and the 20 kHz audio signal sampled at 44.9 kHz with 16 bits is to be encoded to provide a bit rate not higher than 64 kbits/ sec per channel, sound quality deterioration by the pre-echo cannot be evaded with the amplification for gain control quantity on the order of five or six with respect to the music signals with an extremely strong attack portion, such as castanets.

SUMMARY OF THE INVENTION

In view of the foregoing, it is an object of the present invention to provide an information encoding method and apparatus, an information decoding method and apparatus and an information transmission method in which gain control may be made in proportion to the degree of amplitude variation of the attack portion and in which encoding, decoding, recording and transmission may be achieved more efficiently with a higher sound quality despite a simplified construction in order to enable pre-echo prevention even with a high signal compression ratio.

In one aspect, the present invention provides an information encoding method and apparatus including resolving an input signal into frequency components, gain controlling the input signal to be resolved into frequency components, and encoding the output information resolved into the frequency components and the control information for gain control. A gain control quantity at an acutely increased portion of the waveform signal is selected from a plurality of magnitudes, with the maximum value of the gain control quantity being 40 dB or more.

In another aspect, the present invention provides an information decoding method and apparatus including decoding a frequency component signal and the gain control compensation information, synthesizing a waveform signal, and gain control compensating an output waveform signal from the synthesizing process. A gain control quantity at an acutely increased portion of the waveform signal is selected from a plurality of magnitudes determined on the basis of the contents of the gain control compensation information, with the maximum value of the gain control quantity being 40 dB or more.

In still another aspect, the present invention provides an information recording medium having recorded thereon the frequency component signal information and the gain control compensation information. The gain control compensation information contains the gain control compensation quantity information and the gain control quantity at an acutely increased portion of the waveform signal is selected from a plurality of magnitudes, with the maximum value of the gain control quantity being 40 dB or more.

With the encoding method and apparatus according to the present invention, the gain control quantity for the gain control for an acutely rising waveform signal portion is selected from plural magnitudes and the maximum value of the gain control quantity is set to 40 dB or higher. That is, the gain control quantity is selected depending on the degree of variation at the attack portion so that it has a maximum value of 40 dB at a waveform portion just ahead of the attack portion. This effectively inhibits the pre-echo even with the high compression ratio to realize more efficient encoding with a higher sound quality.

With the encoding method and apparatus according to the present invention, the gain control quantity for the gain control for an acutely rising waveform signal portion is selected from plural magnitudes determined on the basis of the contents of the gain control compensation information. Since the gain control quantity corresponding to the gain control compensation quantity has a maximum value of 40 dB or higher, efficient decoding may be achieved and high quality signals may be produced.

DESCRIPTION OF THE PREFERRED EMBODIMENTS

Figure 1A:
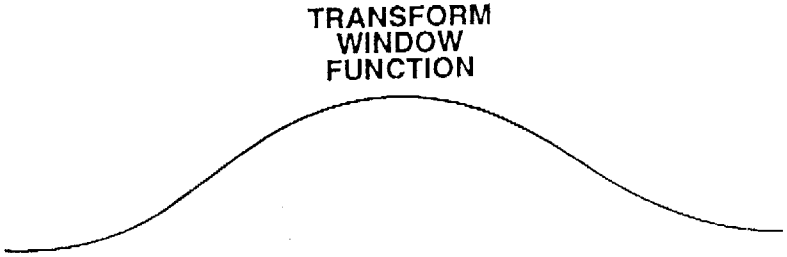
FIG.1(A) (PRIOR ART)
FIGS. 1(A) and 1(B) illustrates the mechanism of pre-echo generation by transform coding.
Figure 1B:
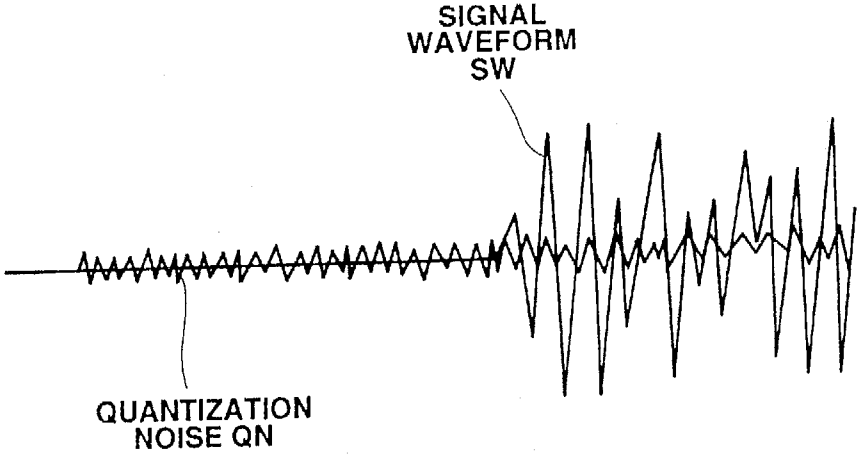
FIG.1(B) (PRIOR ART)
Figures 2A, 2B:
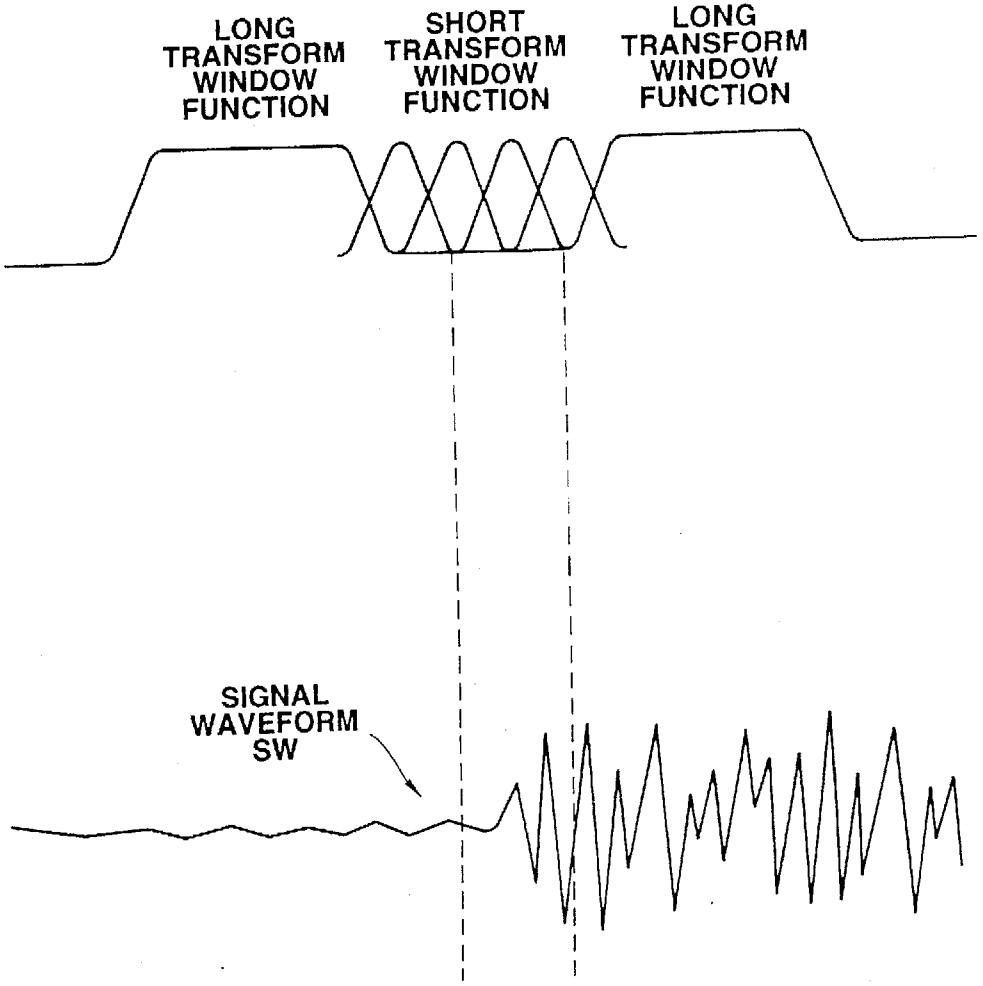
FIG.2(A) (PRIOR ART)
FIG.2(B) (PRIOR ART)
FIGS. 2(A) and 2(B) illustrate the operating principle of the encoding/ decoding technique with conventional transform window length variation.
Figure 3:
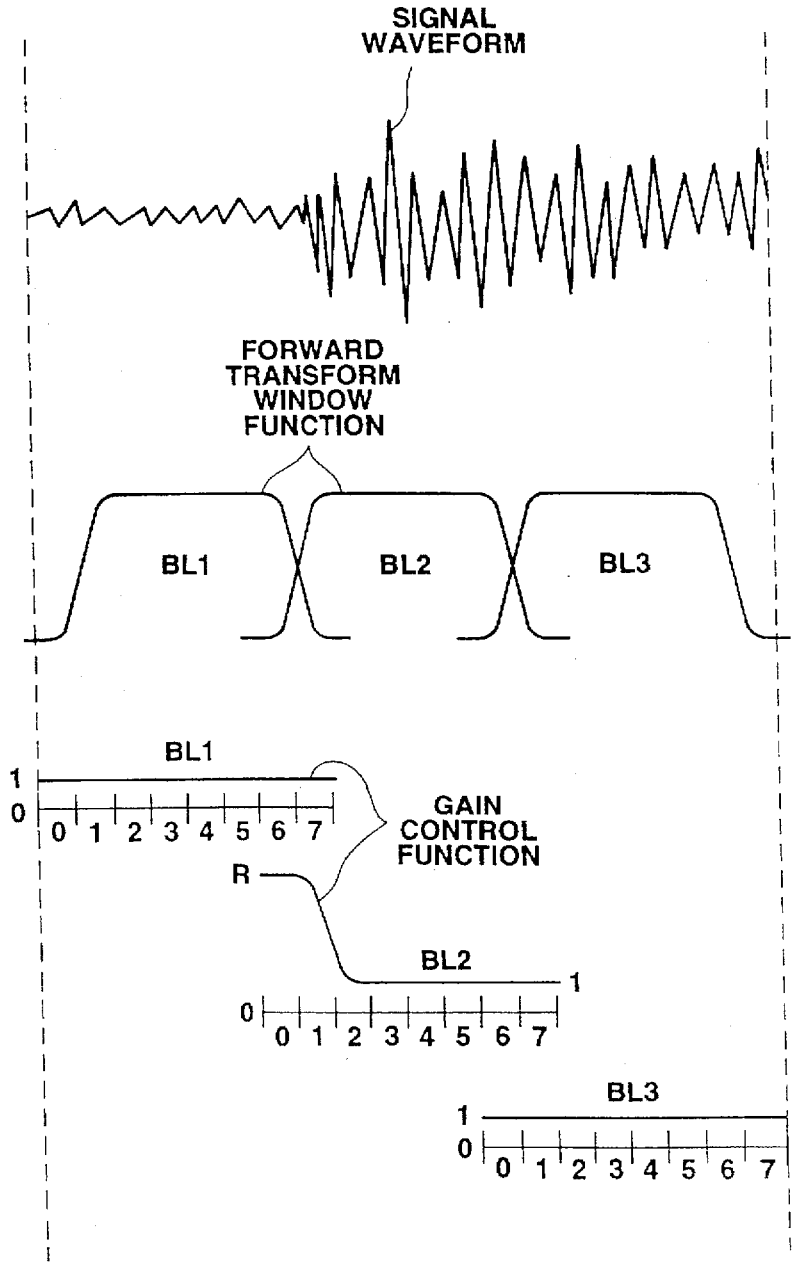
FIG. 3 (A) (PRIOR ART)
FIG. 3 (B) (PRIOR ART)
FIG. 3 (C) (PRIOR ART)
FIGS. 3(A), 3(B) and 3(C) illustrate the mechanism of encoding and decoding employing the conventional windowing technique.

Referring to the drawings, preferred illustrative embodiments of the present invention will be explained in detail.

Figure 6:
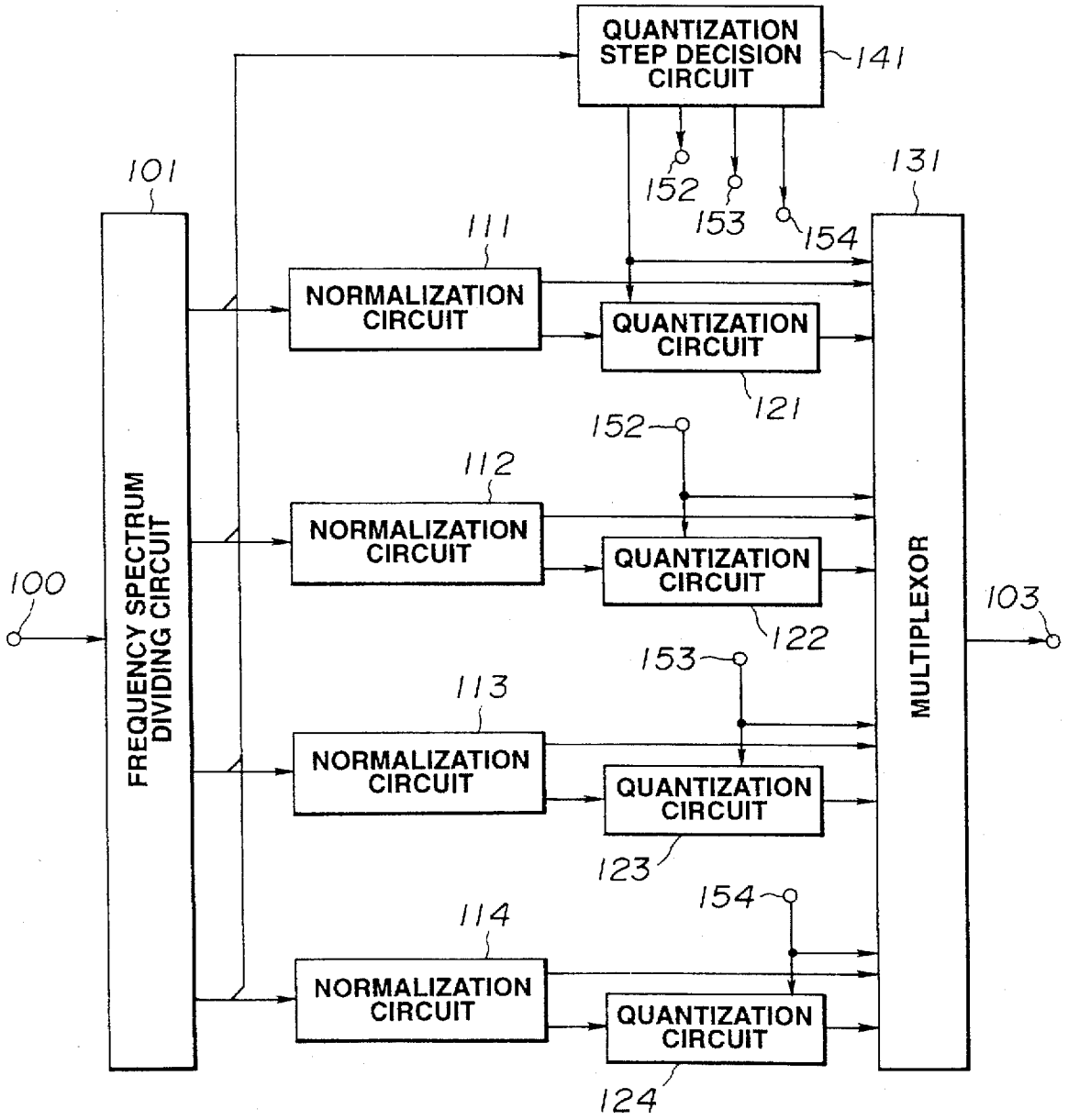
FIG. 6 is a schematic block circuit diagram showing the construction of an encoding apparatus embodying the present invention.

In FIG. 6, an audio signal entering an encoding device at an input terminal 100 is divided in frequency by a frequency spectrum dividing circuit 101. The frequency spectrum dividing means employed in the frequency spectrum dividing circuit 101 may be any of dividing means by the QMF or means for grouping spectral signals resulting from orthogonal transform by MDCT on the band basis. The input audio signal may also be divided by a filter in frequency into plural bands and the resulting spectral signals may then be grouped on the band basis. The frequency bands may be of equal width or of unequal width, as in the case of the critical bands. Although the frequency spectrum is divided into four bands, the number may be increased or decreased in any desired manner.

The input signal divided in frequency by the dividing circuit 101 is normalized by normalization circuits 111, 112, 113 and 114 from one time block to another and thereby resolved into normalization coefficients and normalized signals. The normalized signals are quantized by quantization circuits 121, 122, 123 and 124, based on the quantization step information outputted by a quantization step decision circuit 141, and thereby converted to normalized quantized signals. In FIG. 6, of the quantization step information supplied from the quantization step decision circuit 141 to the quantization circuits 121 to 124, the quantization step information to be supplied to the quantization circuits 122, 123 and 124 is supplied thereto via terminals 152, 153 and 154, respectively.

The normalized and quantized signals from the quantization circuits 121, 122, 123 and 124, the normalization coefficients from the normalization circuits 111, 112, 113 and 114 and the quantization step decision circuit 141 are multiplexed by a multiplexor 131 to form a time-sequential code string which is outputted at a terminal 103. The code string is subsequently recorded on a recording medium, such as a disc, tape or semiconductor, or transmitted via a transmission system.

In the embodiment of FIG. 6, the quantization step decision circuit 141 calculates the quantization step based on the signals divided in frequency by the dividing circuit 101. However, the quantization step may also be calculated from the signal entering the input terminal 100, that is the signal prior to frequency spectrum division. The calculations by the quantization step decision circuit 141 may also be made based on the psychoacoustic phenomenon, such as masking effects. The quantization step information is outputted via the multiplexor 131 so as to be transmitted to the decoding device. Thus the model simulating the human auditory system may be set in any optional manner.

Figure 7:
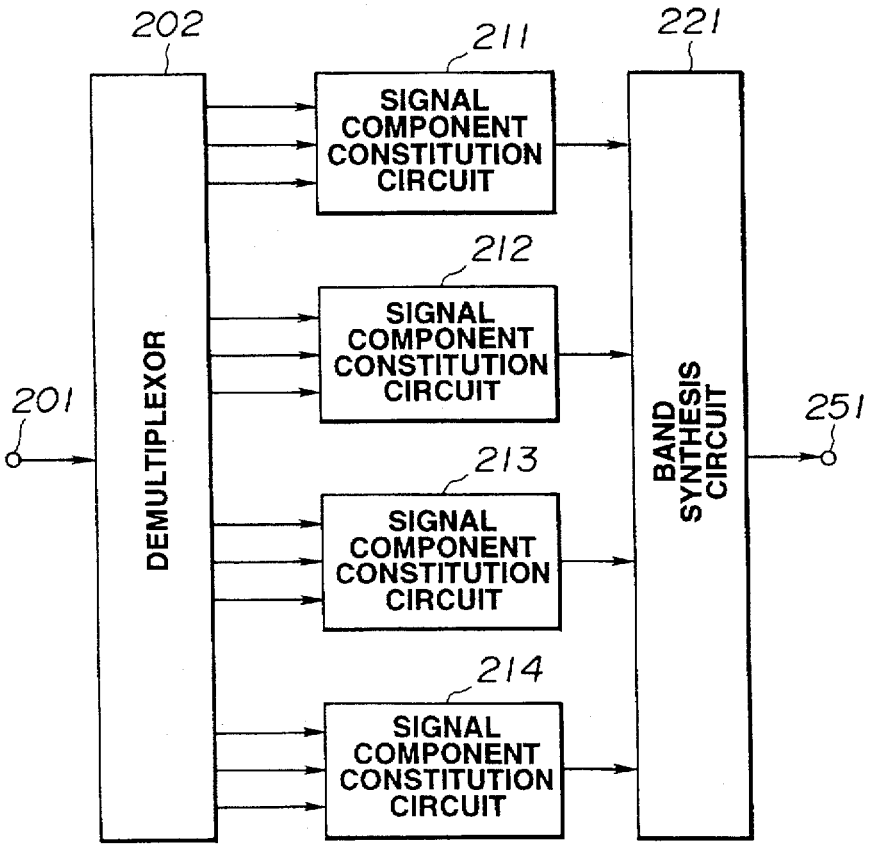
FIG. 7 is a schematic block circuit diagram showing the construction of a decoding apparatus embodying the present invention.

FIG. 7 shows, in a block diagram, an embodiment of a decoding device which is a counterpart device of the encoding device of FIG. 6 and to which the information decoding method according to the present invention is applied.

In FIG. 7, the code information (code string) entering a terminal 201 of the decoding device of the embodiment illustrated is routed to a demultiplexor 202 where it is separated into the quantization step information, normalization coefficients and normalized quantized signals on the band-basis. The band-based quantization step information, normalized coefficients and the normalized and quantized signals are routed to signal component constructing circuits 211, 212, 213 and 214 associated with the respective bands so as to be constructed into band-based signal components. The signal components from the signal component constructing circuits 211, 212, 123 and 214 are synthesized by the band synthesis circuit 221 to form an audio signal which is outputted at a terminal 251.

Figure 8:
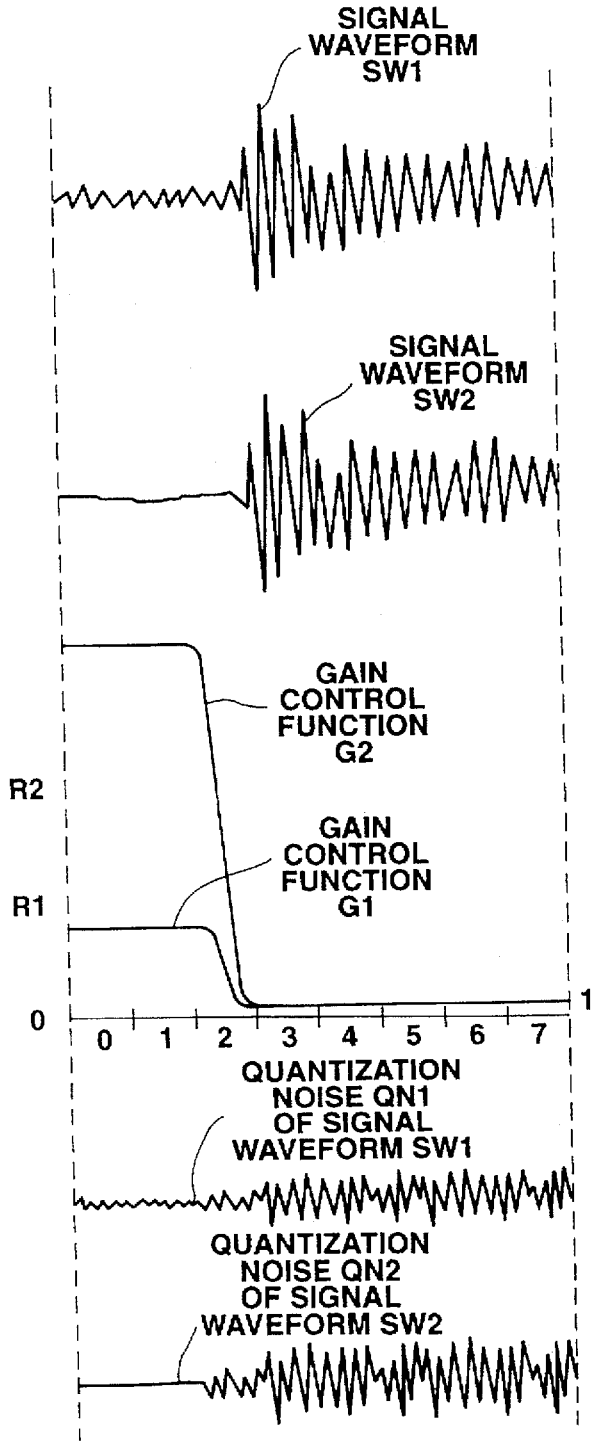
FIGS. 8(A), 8(B) and 8(C) illustrates the gain control operation for windowing in the embodiment shown in FIG. 6.

FIGS. 8(A), 8(B) and 8(C) illustrates the gain control operation for windowing according to the present invention.

With the method shown in the above-described prior-art example, if the maximum value of the gain control quantity is set to about 20 dB, and the sound is such that the waveform signal is changed by more than 40 dB in a short time period of several msec over the entire range or in a high range as with the sound of the castanets, it is not possible to suppress the pre-echo sufficiently by gain control even although attempts are made for encoding the audio signals of 20 kHz sampled at 44.1 kHz with 16 bits to produce a bit rate of 64 kbits per second per channel.

With the method of the present invention, this inconvenience is overcome by varying the gain control quantity depending on the degree of amplitude change in the attack portion of the signal waveform and by effectuating gain control of 40 dB or higher for larger amplitude changes. That is, with the method of the present invention, a gain control function G1 with a smaller gain control quantity is applied to a signal waveform SW1 in order to perform gain control and gain control adjustment, while a gain control function G2 with a larger gain control quantity is applied to a signal waveform SW2 in order to perform gain control and gain control adjustment, as shown in FIG. 8(B). As for the signal waveform SW2, amplitude changes on the order of 40 dB are produced at the attack portion. The gain control quantity R2 of the gain control function G2 is on the order of 40 dB, although it cannot be read from the scale of FIG. 8(B).

If the gain control quantity is increased excessively, the encoding efficiency is lowered due to energy diffusion in the frequency domain to deteriorate the sound quality. However, if the audio signal sampled at 44.1 kHz at 16 bits is to be encoded to provide a bit rate of 128 kbits/ sec or less per channel, it is possible to suppress sound quality deterioration due to energy diffusion in the frequency range and sound quality deterioration due to deterioration in the coding efficiency by suppressing the upper limit of the gain control quantity to not higher than 70 dB.

The manner in which the quantization noise is generated in such case is shown in FIG. 8(C). While the quantization noise ahead of the attack portion of the quantization noise of the signal waveform SW1 is larger than the quantization noise ahead of the attack portion of the quantization noise of the signal waveform SW2, since the noise suppression by the gain control compensation is smaller, the energy of the quantization noise in its entirety is smaller, as shown in FIG. 8(C). On the other hand, although t he energy of the quantization noise for the signal waveform SW2 in its entirety is larger, the quantization noise ahead of the attack portion is suppressed to a sufficiently low level. Since the pre-echo is offensive to the ear, it is desirably suppressed in preference to suppressing the overall noise energy.

Figure 4:
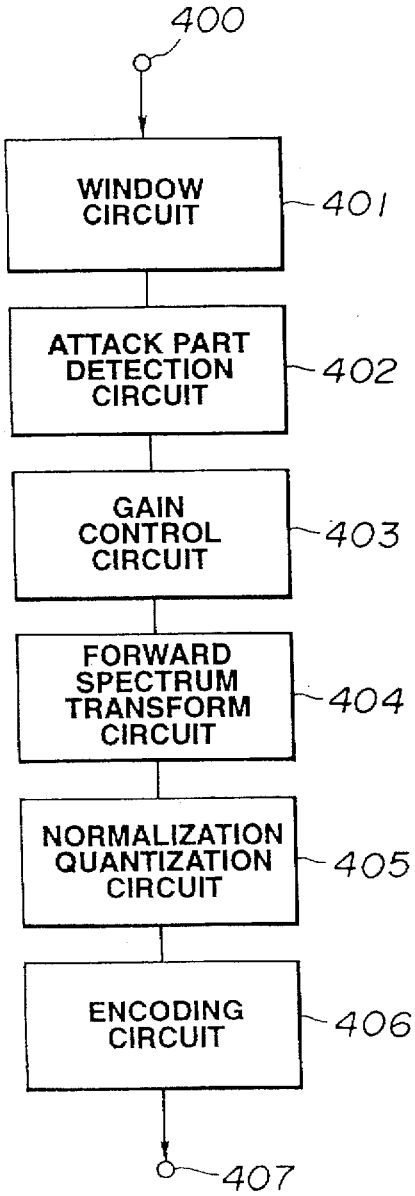
FIG.4 (PRIOR ART)
FIG. 4 is a schematic block diagram showing the construction of an encoding apparatus employing the conventional windowing technique.
Figure 9:
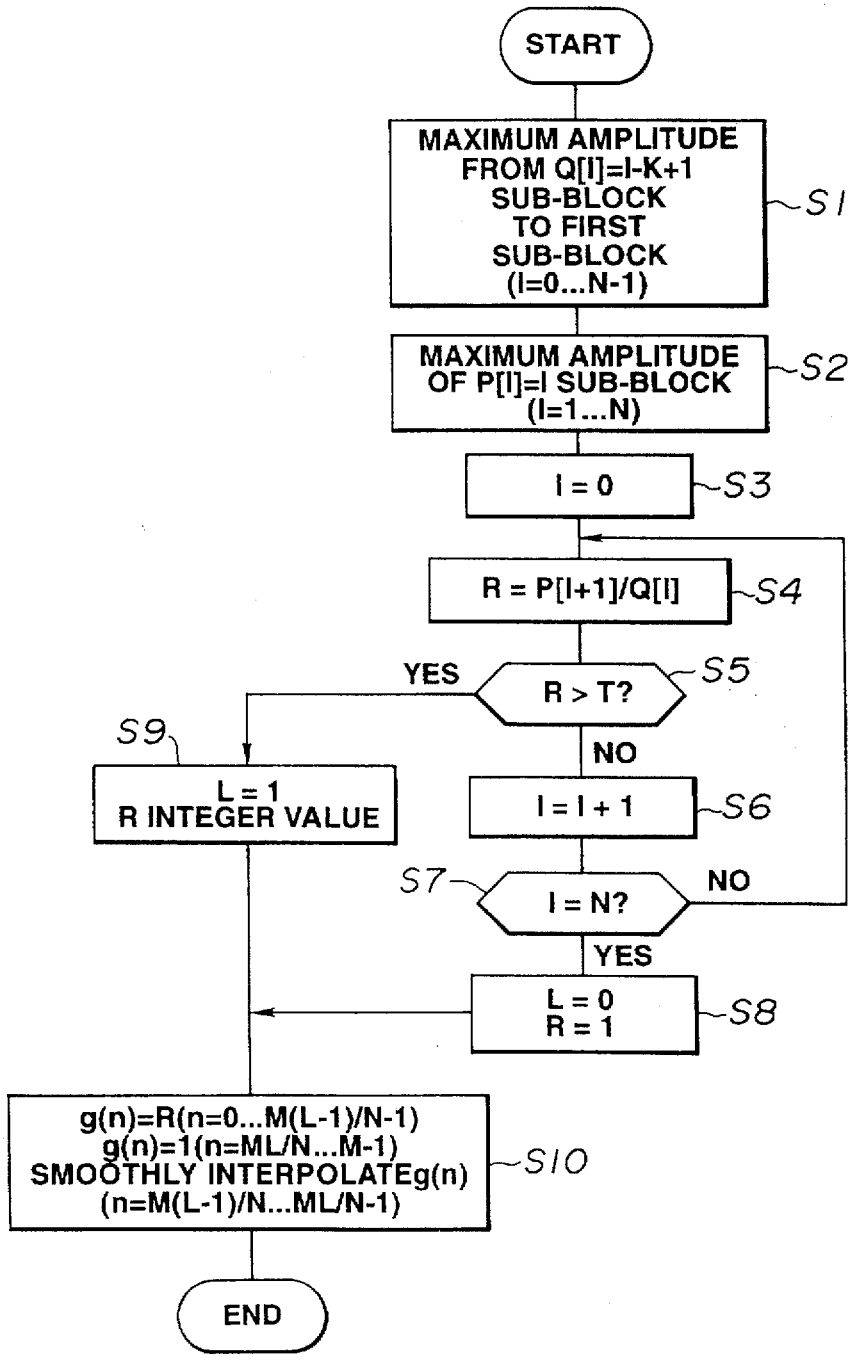
FIG. 9 is a flow chart schematically showing an example of process steps for generating gain control functions in the encoding method embodying the present invention.

FIG. 9 shows an example of process flow for detecting the attack portion for generating the control function when the embodiment of the present invention is applied to signal encoding. The encoding method of the present invention may be implemented by constructing the present processing in the processing corresponding to an attack portion detection circuit 402 of the encoding device shown in FIG. 4.

In FIG. 9, a block which is 2M in length is divided into N sub-blocks, and the maximum amplitude value P[I] in the Ith sub-block is compared to the maximum amplitude Q[I] in K consecutive sub-blocks up to the Ith sub-block. If the value P[I] is larger by more than a pre-set ratio than the value Q[I], it is assumed that the attack portion has been detected. A gain control function having a smooth transient portion is ultimately constituted in order to prevent energy diffusion on effectuating orthogonal transform.

That is, at a first step S1 in FIG. 9, a maximum amplitude value Q[I] from K consecutive sub-blocks up to the Ith sub-block, that is from the (I–K+1)th sub-block up to the Ith sub-block is found. The sub-block is one of N equal-length portions of 1 block. At step S2, the maximum amplitude value P[I] is found. At the next step S3, I is set to 0. At step S4, the gain control quantity R is found as a ratio of the maximum amplitude Q[I] of K sub-blocks up to the Ith sub-block to the maximum amplitude P[I+1] of the next succeeding sub-block. At the next step S5, the attack portion is assumed to be detected when R is larger than a pre-set threshold T. The program then shifts to step S9. If the result is NO, the program shifts to step S6 to increment I. At step S7, it is determined if I reaches the sub-block number N at the block end. The process since step S4 is repeated until I=N. If the result at step S7 is YES, L is set to 0 at step S8, that is, the attack is assumed to be absent. R is set to 1 (R=1) before the program shifts to step S10. If the result at step S5 is YES, that is if the attack is found, the program shifts to step S9. L is set to 1 (L=1) and an integer of R as found at step S4 is substituted for R. That is, the length ahead of the attack portion in the block is construed as being equal to L sub-blocks. The value of R at this time represents the gain control quantity. After the processing at step S9, the program shifts to step S10.

At step S10, the gain control functions of the sub-blocks up to the attack position L is set to R, while the remaining gain control functions are set to 1. The transient portion is ultimately smoothed before the processing comes to a close. That is, at the step S10, the gain control function g(n) is constituted on the basis of the values of L and R, while the function values are interpolated smoothly in the sub-blocks directly ahead of the attack portion in order to enable efficient encoding by inhibiting diffusion of energy distribution on effectuating the transform to the frequency domain.

By varying the gain control quantity for the attack portion depending on the signal level, the pre-echo may be prevented effectively from occurring even although the compression ratio is higher.

Although the gain control is amplified only directly before the attack portion, this represents exploitation of the forward masking effect as discussed previously. Of course, it is possible to effect gain control so that the small amplitude portion is amplified during attenuation. If the block length for orthogonal transform is extremely long such that sufficient forward masking effect cannot be expected, the small amplitude portion may be amplified during attenuation. The number of the attack portions to be detected need not be one per block.

If a function showing step-like acute changes is used as the gain control function, the encoding efficiency is lowered due to energy diffusion. Thus it is desirable for the control function to be smoothly changed at the attack portion. However, if the domain is not sufficiently long, the pre-echo becomes audible. It is therefore desirable in view of the human auditory system that the gain control function has a transient period on the order of 1 msec and is smoothly changed during the period like a sine wave. By enlarging the range of detection of the attack portion to the leading sub-block of the next block in readiness for the attack being at the leading end of the next block, it becomes possible to satisfy the relation for interference of waveform elements between neighboring blocks at the time of the above-mentioned inverse transform while providing the gain control function with a smooth transient portion.

Thus the method and apparatus of the present invention may be applied to processing the digitized acoustic waveform as well as to computer processing of waveform signals in the form of a file. The code data thus produced may be transmitted or recorded on a recording medium. The present invention may be applied to encoding at a pre-set bit rate at all times, or to encoding at a temporally variable bit rate so that the number of allocated bits is different from block to block.

The foregoing description has been made of directly transforming the waveform signal digitized by the encoding device into spectral signals by orthogonal transform. The method of the present invention may naturally be applied to transforming the waveform signal previously divided in frequency into plural bands by a frequency spectrum dividing filter into spectral signals on the band basis.

Figure 10:
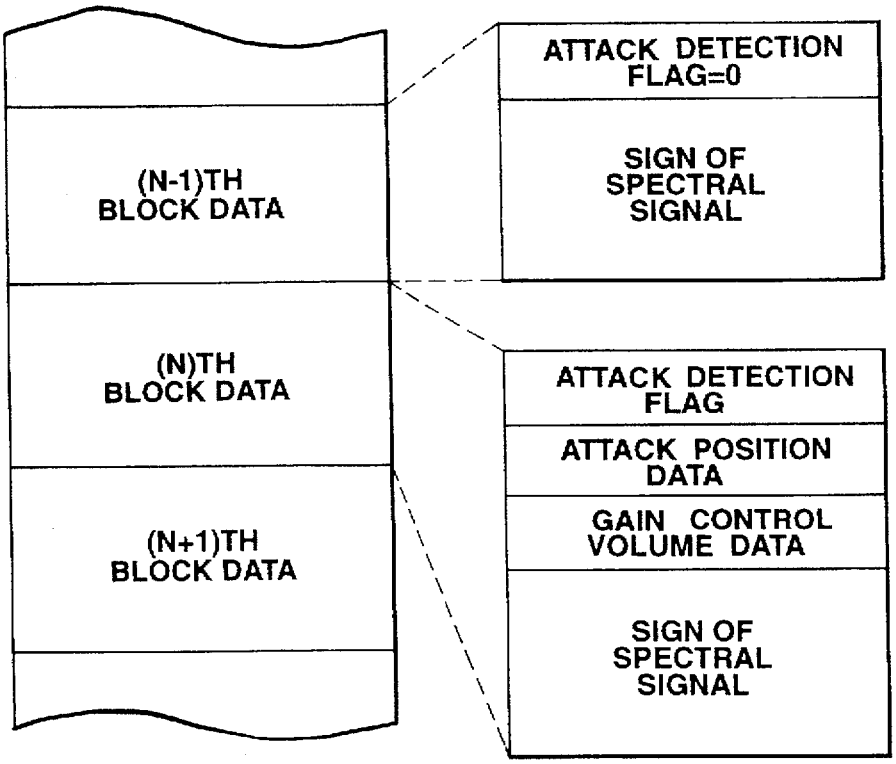
FIG. 10 illustrates the recording state of the code string obtained by encoding according to the present invention.

FIG. 10 shows an example of a recording format and a transmission format for recording the information encoded by the method of the present invention on a recording medium or a transmission format for transmitting the information encoded by the method of the present invention.

In the example shown in FIG. 10, the code of each block is constituted by an attack portion detection flag and a spectral signal code. Depending on the contents of the attack portion detection flag, the code of each block also includes the gain control compensation function generating information consisting of the attack part detection flag and the gain control information. It suffices to record the value of L and the value of R in FIG. 9 as the attack position information and as the gain control quantity information, respectively. Since the ratio of the blocks containing the attack part presenting the problem of pre-echo is low in actual music signals, it is efficient to record the attack position information and the gain control quantity information only in the blocks actually containing the attack portions. Of course, the gain control compensation function generating information may be recorded in the entire blocks, in which case it suffices to make such recording with L =0 and R=0 in the block not containing the attack portion.

Figure 11:
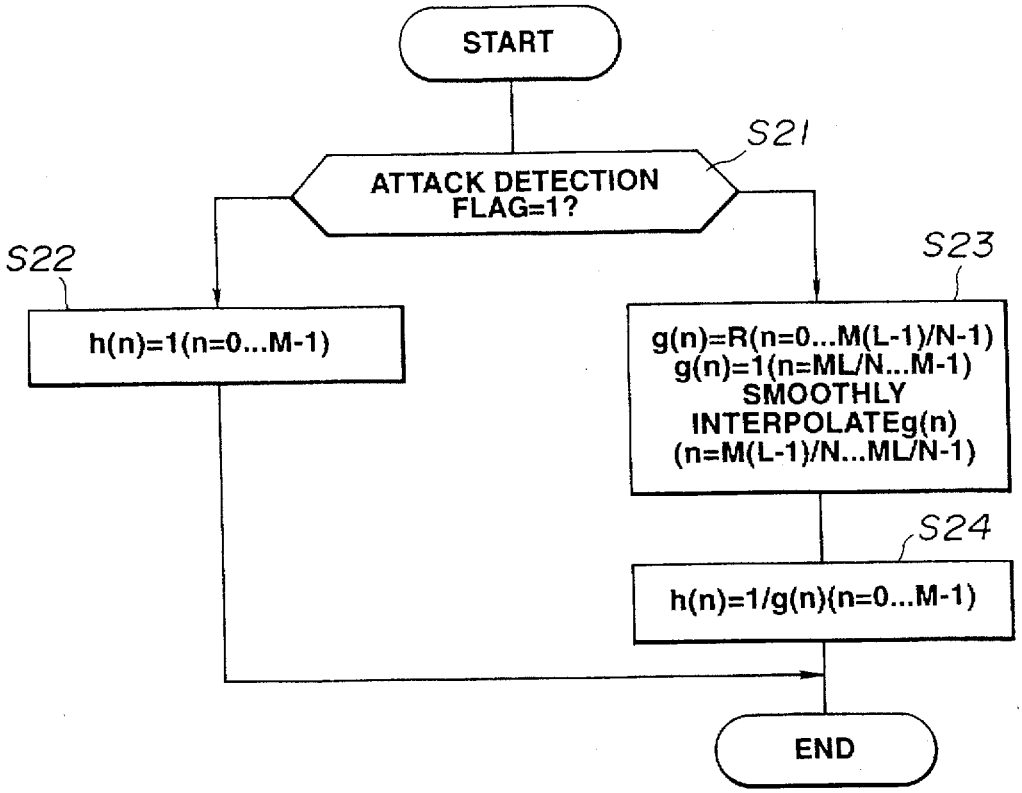
FIG. 11 is a flow chart schematically illustrating an example of a portion of the process steps of the decoding method embodying the present invention.

FIG. 11 shows a processing example in which the decoding means generates the gain control compensation function h(n) from the recording information shown in FIG. 10.

Figure 5:
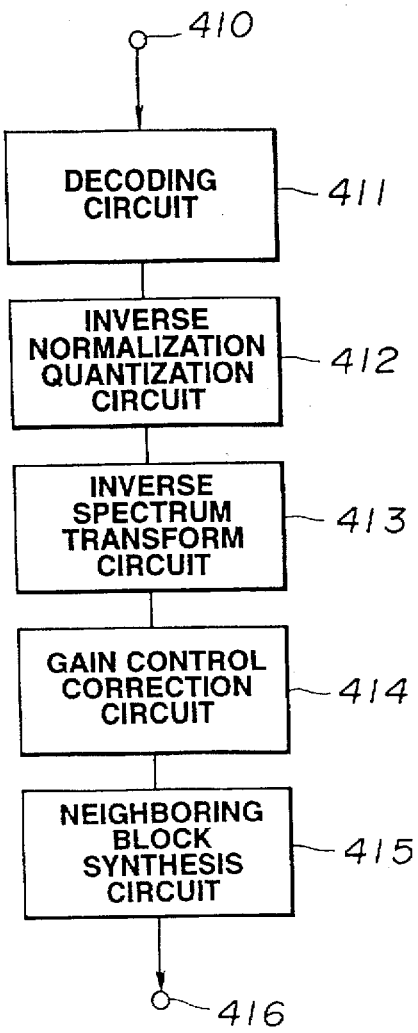
FIG.5 (PRIOR ART)
FIG. 5 is a schematic block diagram showing the construction of a decoding apparatus employing the conventional windowing technique.

For example, the decoding method of the present invention may be carried out by constructing the processing shown in FIG. 11 in a processing corresponding to the gain control compensation circuit 414 of the decoding apparatus shown in FIG. 5 and multiplying the generated gain control compensation function h(n) with the waveform signal element constituted by the orthogonal transform circuit 413. The step of multiplying h(n) may naturally be omitted for a block in which no attack portion has been detected.

In the example of FIG. 11, the attack detection flag is detected at step S21. If the flag is 0, that is if no attack is detected, the program shifts to step S22 where the gain control compensation function h(n) is set to 1. The program then comes to an end. If the flag is 1, that is if the flag is detected, the program shifts to step S23 where the gain control function g(n) of L sub-blocks from the leading end of the block is set to R and the above-mentioned interpolation is carried out in order to find the ultimate gain control function g(n). At the next step S24, a reciprocal of the gain control function g(n) (1/g(n)) is calculated to find the gain control compensation function h(n).

The present method may naturally be applied to a method as described in the above-identified JP Patent Kokai Publication JP-A-3-132228.

The present invention may naturally be applied not only to directly transforming the waveform signal into frequency components by orthogonal transform but to transforming the waveform signal previously divided in frequency into plural frequency bands by a frequency spectrum dividing filter. The present invention may also be applied to dividing the waveform signal in frequency into plural frequency components by a filter. Although the frequency components in the present invention are meant to cover those resulting from the above processing, the method of the present invention has utmost effects when the frequency components are those obtained by processing including orthogonal transform in which the pre-echo raises a significant problem.

The present invention may also be applied to processing acoustic signals transformed into digital signals, or to computer processing waveform signals in the form of a file. In addition, the present invention may be applied not only to encoding at a constant bit rate at all times, but to encoding at a temporally variable bit rate so that the number of allocated bits differs from block to block.

A,though the above description has been made in connection with rendering the quantization noise on quantization of the acoustic waveform signal less obtrusive, the present method is also effective for rendering the quantization noise of other types of signals less obtrusive and may thus be applied to picture signals. However, since the pre-echo in the acoustic signals presents serious problem in connection with the human auditory system, the present invention may be most effectively applied to acoustic signals. The present invention may also be naturally be applied to multi-channel acoustic signals.

What is claimed is:

1. An information encoding method comprising resolving an input signal into frequency components, gain controlling the input signal to be resolved into frequency components, encoding the output information resolved into the frequency components and the control information for gain control, and selecting a gain control quantity at an acutely increased portion of the waveform signal from a plurality of magnitudes, with the maximum value of the gain control quantity being 40 dB or more.

2. The information encoding method as claimed in claim 1 wherein the maximum value of the gain control quantity is not more than 70 dB.

3. The information encoding method as claimed in claim 1 wherein the compression ratio by encoding is not higher than ¼.

4. The information encoding method as claimed in claim 1 wherein the process of resolving the input signal into the signal on the frequency axis includes the orthogonal transform.

5. The information encoding method as claimed in claim 1 wherein the input signal is an acoustic signal.

6. An information decoding method comprising decoding a frequency component signal and the gain control compensation information, synthesizing a waveform signal, gain control compensating an output waveform signal from the synthesizing process, and selecting a gain control compensation quantity for the gain control compensation operation at an acutely increased portion of the waveform signal from a plurality of magnitudes determined on the basis of the contents of the gain control compensation information, with the maximum value of the gain control quantity corresponding to the gain control compensation quantity being 40 dB or more.

7. The information decoding method as claimed in claim 6 wherein the maximum value of the gain control quantity is not more than 70 dB.

8. The information decoding method as claimed in claim 6 wherein the compression ratio by encoding is not higher than ¼.

9. The information decoding method as claimed in claim 6 wherein the process of resolving the input signal into the signal on the frequency axis includes the orthogonal transform.

10. The information decoding method as claimed in claim 6 wherein the input signal is an acoustic signal.

11. An information transmission method wherein the frequency component signal information and the gain control compensation information are transmitted, the gain control compensation information contains the gain control compensation quantity information, and wherein a gain control compensation quantity at an acutely increased portion of the waveform signal is selected from a plurality of magnitudes, with the maximum value of the gain control quantity corresponding to the gain control compensation quantity being 40 dB or more.

12. The information transmission method as claimed in claim 11 wherein the maximum value of the gain control quantity corresponding to the gain control compensation quantity is not more than 70 dB.

13. The information transmission method as claimed in claim 11 wherein the compression ratio by encoding is not higher than ¼.

14. The information transmission method as claimed in claim 11 wherein the process of resolving the input signal into the signal on the frequency axis includes the orthogonal transform.

15. The information transmission method as claimed in claim 11 wherein the input signal is an acoustic signal.

16. An information encoding apparatus comprising means for resolving an input signal into frequency components, means for gain controlling the input signal to be resolved into frequency components, and means for encoding the output information resolved into the frequency components and the control information for gain control, wherein a gain control quantity at an acutely increased portion of the waveform signal is selected from a plurality of magnitudes, with the maximum value of the gain control quantity being 40 dB or more.

17. The information encoding apparatus as claimed in claim 16 wherein the maximum value of the gain control quantity is not more than 70 dB.

18. The information encoding apparatus as claimed in claim 16 wherein the compression ratio by encoding is not higher than ¼.

19. The information encoding apparatus as claimed in claim 16 wherein the process of resolving the input signal into the signal on the frequency axis includes the orthogonal transform.

20. The information encoding apparatus as claimed in claim 16 wherein the input signal is an acoustic signal.

21. An information decoding apparatus comprising means for decoding a frequency component signal and the gain control compensation information, means for synthesizing a waveform signal, and means for gain control compensating an output waveform signal from the synthesizing process, wherein a gain control quantity for the gain control compensation at an acutely increased portion of the waveform signal is selected from a plurality of magnitudes determined on the basis of the contents of the gain control compensation information, with the maximum value of the gain control quantity corresponding to the gain control compensation quantity being 40 dB or more.

22. The information decoding apparatus as claimed in claim 21 wherein the maximum value of the gain control quantity is not more than 70 dB.

23. The information decoding apparatus as claimed in claim 21 wherein the compression ratio by encoding is not higher than ¼.

24. The information decoding apparatus as claimed in claim 21 wherein the process of resolving the input signal into the signal on the frequency axis includes the orthogonal transform.

25. The information decoding apparatus as claimed in claim 21 wherein the input signal is an acoustic signal.

26. An information recording medium having recorded thereon the frequency component signal information and the gain control compensation information, said gain control compensation information contains the gain control compensation quantity information and wherein the gain control compensation quantity at an acutely increased portion of the waveform signal is selected from a plurality of magnitudes, with the maximum value of the gain control quantity corresponding to the gain control compensation quantity being 40 dB or more.

27. The information recording medium as claimed in claim 26 wherein the maximum value of the gain control quantity is not more than 70 dB.

28. The information recording medium as claimed in claim 26 wherein the compression ratio by encoding is not higher than ¼.

29. The information recording medium as claimed in claim 26 wherein the process of resolving the input signal into the signal on the frequency axis includes the orthogonal transform.

30. The information recording medium as claimed in claim 26 wherein the input signal is an acoustic signal.

* * * * *